US005926919A

United States Patent [19]

Varga

[11] Patent Number: 5,926,919

[45] Date of Patent: Jul. 27, 1999

[54] CARD WASTE MONITORING

[75] Inventor: John Varga, Halifax, United Kingdom

[73] Assignee: Carding Specialist Limited, Ontario, Canada

[21] Appl. No.: 08/817,283

[22] PCT Filed: Oct. 10, 1995

[86] PCT No.: PCT/GB95/02395

§ 371 Date: Jul. 7, 1997

§ 102(e) Date: Jul. 7, 1997

[87] PCT Pub. No.: WO96/11292

PCT Pub. Date: Apr. 18, 1996

[30] Foreign Application Priority Data

Oct. 10, 1994 [GB] United Kingdom ..... 9420372

[51] Int. Cl.[6] ..... D01G 15/76

[52] U.S. Cl. ..... 19/107; 19/22; 19/98; 19/102; 19/106 R

[58] Field of Search ..... 19/22, 23, 65 R, 19/98, 99, 102, 106 R, 107, 108

[56] References Cited

U.S. PATENT DOCUMENTS

| | | | |
|---|---|---|---|
| 4,776,066 | 10/1988 | Leifeld | 19/106 R |
| 4,805,268 | 2/1989 | Leifeld | 19/107 |
| 4,823,440 | 4/1989 | Pinto | 19/106 R |
| 4,953,265 | 9/1990 | Scheinhutte | 19/106 R |
| 5,361,458 | 11/1994 | Demuth et al. | 19/98 |

FOREIGN PATENT DOCUMENTS

| | | | |
|---|---|---|---|
| 0012 691 A1 | 6/1980 | European Pat. Off. . | |
| 0 248 649 AZ | 9/1987 | European Pat. Off. . | |
| 2 597 515 | 10/1987 | France . | |
| 2 634 789 | 2/1990 | France . | |
| 2210643 | 6/1989 | United Kingdom | 19/23 |
| WO 96/11292 | 4/1996 | WIPO . | |

OTHER PUBLICATIONS

Yasuhiro M., Abstract JP60231827, *Waste Cotton Controller in Comber*, vol. 10 No. 103, Nov. 1985.

Yasuhiro M., Abstract JP840186986 *Under–Casing of Card Using Shape–Memory Alloy*, vol. 10 No. 230, Jan. 1986.

*Primary Examiner*—William Stryjewski
*Attorney, Agent, or Firm*—Workman, Nydegger & Seeley

[57] ABSTRACT

A carding machine for treating a fibrous feedstock and having an adjustable cleaning device arranged at any position on the machine where removal of waste from the feedstock is required while undergoing treatment, and a machine management device for monitoring the waste removal by the cleaning device and for providing a compensatory feedback adjustment of the cleaning device when the monitored waste deviates from a desired state, in which the monitoring of the waste removed can comprise a weighing device, an optical device, or a filter device which acts on a stream of air-borne waste.

12 Claims, 4 Drawing Sheets

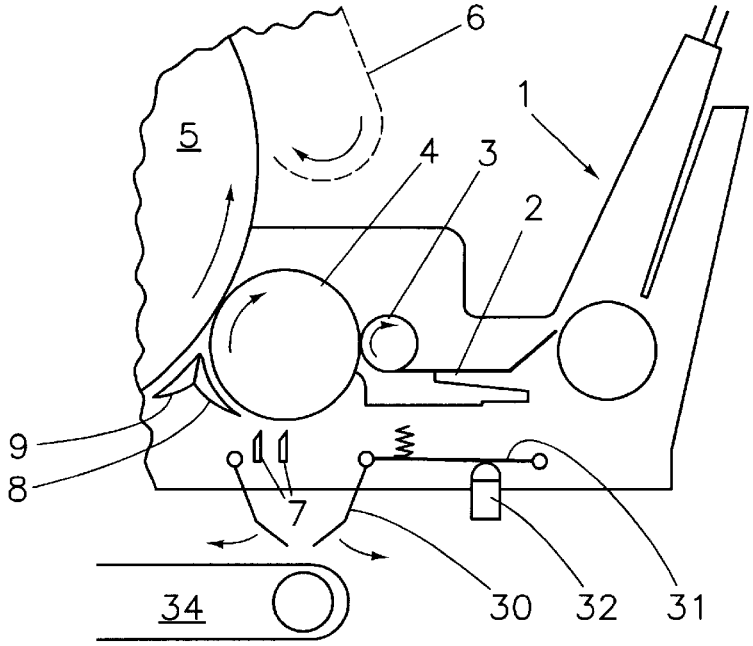
FIG. 1
(PRIOR ART)
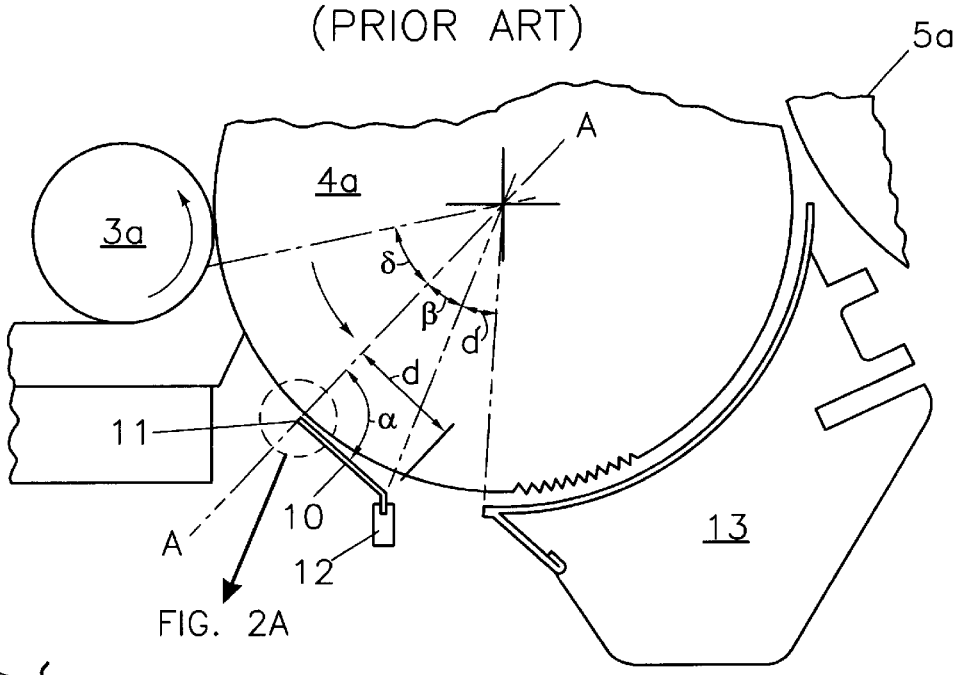
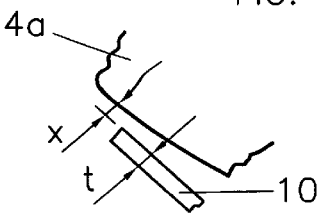
FIG. 2
(PRIOR ART)
FIG. 2A
(PRIOR ART)

CARD WASTE MONITORING

BACKGROUND OF THE INVENTION

1. Field of the Invention

This invention relates to a cleaning system for a carding machine, and in particular to a card waste management system for use with a carding machine. One 2. Present State of the Art One function of the carding process is to remove as much trash and dust from the feedstock as possible in order that the sliver resulting from the carding process will be as clean as possible and can be spun into a yarn of correspondingly high quality. There are many regions on the conventional carding machine where cleaning is effected. One of these is on the lower arc of the takerin as feedstock is transferred on that roller from the feed plate to the main carding cylinder. The usual cleaning arrangement in this region of the carding machine is the mounting of one or more mote knives adjacent to the lower arc of the takerin. Mote knives are effective in removing a certain amount of trash and dust from the feedstock carried by the takerin.

One particularly effective mote plate type of cleaning mechanism for a carding machine is disclosed in EP-B-248649 in the name Carding Specialists (Canada) Limited, and to which reference is directed. The disclosure in EP-248649 is incorporated herein by this reference.

For a fuller disclosure of the inventive mote plate cleaning mechanism described and claimed in this European patent, reference should be had to the full copy of the text. However, brief description will be made below of a preferred embodiment of the mote plate arrangement disclosed in EP-248649, to form background and to assist the description and definition of examples of improved cleaning system for a carding machine, and card waste management system which is the subject of the present patent application. Reference will therefore now be made to FIGS. 1, 2 and 2A of the accompanying drawings, which comprise:

FIG. 1 is a schematic side elevation of the feed region of a conventional carding machine, and illustrates a known mote knife arrangement; and, FIG. 2 is a side elevation of part of the feed region of a carding machine showing a mote knife cleaning system which forms the subject of EP-248649.

Referring to FIG. 1, there is shown part of a prior art carding machine having a chute feed arrangement 1, a feed plate 2, a feed roller 3 cooperating with the feed plate, a takerin 4, a main carding cylinder 5 and a set of rotating flats 6. The feed roller conveys feed stock from the feed plate 2 to the main carding cylinder 5 along the lower arc of the takerin, and positioned adjacent to this lower arc there are two mote knives 7. A takerin screen 8 is mounted in the region between the takerin and the main carding cylinder, and abuts a cylinder screen 9. It will be seen that each of the mote knives 7 extends substantially diametrically of the takerin and terminates in a free edge that is substantially at right angles to the direction of rotation of the takerin. The mote knives act to divert trash and dust from the fibres carried by the takerin, but their efficiency is generally recognised as being limited, and they are also prone to removing lint and short fibre that could advantageously be incorporated into the finally carded web.

FIGS. 2 and 2A show part of a carding machine similar to that shown in FIG. 1, but modified in accordance with a first embodiment of the invention which is the subject of EP-248649. In this embodiment, the mote knives are replaced by a substantially rigid, flat plate 10 which extends across the full width of the takerin 4*a*, downstream of the feed roller 3*a*, and which terminates in a leading edge 11 that is substantially parallel to the axis of the takerin and that faces into the direction of rotation of the takerin. The plate may suitably be metal sheeting, the sheeting having a thickness t of from 1 to 3 mm, with 1.5875 mm sheet presently preferred. The plate is supported by a support bar 12 which extends the full width of the carding machine and is mounted between the side frame members of the carding machine. The plate is followed in the downstream direction by a takerin screen 13, extending to the region of cooperation between the takerin and the main carding cylinder 5*a*. The leading edge 11 of the plate is spaced from the tips of the teeth on the takerin by a distance x of not more than 5 mm, and preferably in the range 0.25 to 5.00 mm; and the plate lies in a plane that makes an angle of from 70° to 120° to a plane A—A radial of the takerin and intersecting the free edge of the plate.

An important aspect of this arrangement is that plate 10 extends generally parallel to a tangent to the periphery of the takerin, and is located in a plane which is inclined at an angle to the tangent which is within the range 15° inwardly of the tangent and 30° outwardly when measured from the leading edge 11 of the plate (the terms inwardly and outwardly are used with reference to the centre A of the takerin 4*a*).

Thus, the angle between the plane of the plate 10 and the tangential plane to the takerin at that region of the takerin which lies closest to the free or leading edge of the plate is not more than 30° where the plate initially diverges from its free edge away from the takerin, and is not more than 15° where the plate initially converges from its free edge towards the takerin. The length d of the plate in the direction of rotation is at least 15 mm, preferably from 22 to 50 mm. The preferred aspect ratio (d/t) of the plate is from 13 to 30, it will be appreciated that the working edge 11 of the plate 10 is in a completely different relationship to the takerin than are the working edges of the mote knives 7, and that the aerodynamic effect of the plate is totally different to that of earlier takerin cleaning arrangements. Surprisingly, it has been found that the arrangement can improve the cleaning efficiency on the takerin by up to some ten per cent, and that the ratio of lint to trash in the undercard droppings below the takerin can be reduced, i.e. more usable fibre is retained.

In a preferred arrangement as shown in FIGS. 2 and 2A, the radial spacing x between the free edge 11 of the plate 10 and the tips of the teeth on the takerin may be from 0.5 to 2.0 mm. the angle $\alpha$ between the plate and the radial plane A—A is from 90° to 100°. The length d of the plate in the direction of rotation is from 30 to 45 mm, with the plate subtending and angle $\beta$ at the centre of a takerin of standard 25.4 cm diameter of from 13° to 21°. The angle $\gamma$ subtended at the centre of the takerin from the nose of the feed plate 2 to the free edge 11 of the plate 10 may preferably be from 30° to 40°. The angle $\delta$ between the trailing edge of the plate 10 and the leading edge of the takerin screen 8 may preferably be from 10 to 3020 . Each of the aforesaid variables may be determined empirically to suit a given feed stock and set of carding conditions, and it is preferred, therefore, that the mounting bar 12 be supported on the side plates of the carding machine in such a way that it may be adjusted to allow variation of the various angles, and also to allow variation of the spacing between the free edge 11 and the tips of the teeth on the takerin. Suitable adjusting arrangements will readily be apparent. In certain cases it may be possible to eliminate the need for the takerin screen 8.

As well as removing trash, dust and short fibre, which will generally be carried away by the conventional card suction cleaning system, some lint will also be removed by the plate 10, and there is a possibility that removed material may accumulate on the surface of the support bar 12 and in the space between the plate 10 and the screen 13. It will usually be preferred that such accumulation is either constantly or periodically removed, and a suitable method of effecting this would be to mount a blower adjacent to the mounting bar 12 so that a stream of air is directed across the surface thereof in order to blow off accumulated material.

The above description of one preferred embodiment of EP-248649 sets the background to which the present invention can be compared.

BRIEF SUMMARY OF THE INVENTION

The present invention is concerned generally with a card waste cleaning and monitoring or management system, whereby "card waste autolevelling" can be achieved. In one preferred application of the invention, the monitoring or management system is applied in the monitoring of the waste which is removed from the takerin of a carding machine which can be collected, and weighed, and from weighing indications, there can be derived an indication of the cleaning efficiency, and this indication may be then used for manual or automatic compensatory adjustment to be made of the cleaning system with respect to the takerin.

However, application of the monitoring/management system to the cleaning carried out in the region of the takerin is only one example of a part of a carding machine to which the invention may be applied. Therefore, it should be understood that the invention is generally applicable to monitoring the waste generated at part of a carding machine where a cleaning device is arranged, and providing a signal when the monitored waste departs from a desired state e.g. from a required value/quality/quantity, and in which such a signal can be utilised to indicate and/or initiate application of compensatory adjustment to the cleaning device.

According to one aspect of the invention there is provided a carding machine for treating a fibrous feedstock and having an adjustable cleaning device arranged at any position on the machine where removal of waste from the feedstock is required, and a machine management device for monitoring the waste removed by the cleaning device and for providing a signal indicative of any deviation in the monitored waste from a desired state, such signal serving to provide an indication of a requirement for compensatory adjustment of the cleaning device.

According to a further aspect of the invention there is provided a carding machine for treating a fibrous feedstock and having an adjustable cleaning device arranged at any position on the machine where removal of waste from the feedstock is required, and a machine management device for monitoring the waste removed by the cleaning device and for providing a compensatory feedback adjustment of the cleaning device when the monitored waste deviates from a desired state.

In one preferred embodiment, the cleaning device is arranged to co-operate with the lower arc of movement of a taker-in, and may comprise any suitable cleaning device, such as an adjustable mote plate and/or mote knife.

In a further example, the cleaning device may be incorporated in a set of movable (revolving) flats co-operating with a carding cylinder, and any compensatory adjustment (when required following a deviation of the monitored waste from a desired state) may comprise adjustment of the speed of the movable flats. Alternatively, with a fixed speed set-up of movable flats and so-called "percentage plate", the necessary adjustment may be applied to the percentage plate in order to vary the flat strip generation.

The machine management/monitoring device may be used to monitor any suitable property of the removed waste (to detect deviation from a desired state) and which will include a mechanical type of monitoring e.g. measurement of the weight of the waste, and which may be on a continuous, or intermittent basis. However, more sophisticated monitoring may include optical monitoring of the properties/content of the waste.

Current card waste management systems are entirely manual, relying upon operator skill and attention in carrying out routine monitoring of the nature of the waste which is removed, and from this making a deduction as to the cleaning efficiency, and then making an appropriate adjustment, where necessary, of the cleaning system when the cleaning efficiency has departed from a required norm.

This purely manual inspection and adjustment necessarily depends, for its effectiveness, upon the degree of skill and attention given to the task by the operator concerned.

"Cleaning efficiency" is determined (by existing methods) by inspection of the waste fibres which are separated, and making a judgement as to the presence, or not, of an unacceptably high level of relatively low quality, but nevertheless usable fibres present in the waste. Clearly, if unacceptably high levels of usable fibres are carried over with the waste, this represents an unacceptable loss of usable fibres from the raw material supply, and is clearly undesirable to the operators of carding machines. Even a figure as low as 1% of usable fibres being carried over into the waste can cost of the order of $10,000 per annum of lost revenue, from the raw material supply.

However, the invention provides for the generation of waste to be monitored by monitoring means e.g. by direct weighing of the waste, or extracted samples thereof, or by use of other means from which cleaning efficiency can be derived e.g. means by which weight of waste being generated can be extrapolated.

The use of such other means also fall within the scope of the present invention. These other means may include optical methods, such as use of "scintillation" techniques; interruptions in the passage of light beams passed through a tube or passage through which the waste particles are conveyed; optical scanning of dust and/or waste held on a filter such as a wire mesh screen; measurement of discolouration on a rotary mesh filter; and the absorbtion/reflection of light along the line of dust generation, such as the absorbtion of light from a beam which runs parallel and near to a slot from which waste is being expelled.

A preferred technique for measuring the quantity of material that is removed from the fibres involves the use of means for measuring the degree of absorption of light by the material. The absorbency measurement can be performed on material as it is transported from the roller, for example in a stream of a gas such as air. It can be performed on the material after collection on a filter.

When the means of measuring the quantity of the removed material comprises a filter by which the material is removed from the transport medium (especially air), the measuring means can include means for measuring the pressure drop across the filter, so that the quantity of material collecting on the filter can be determined by monitoring the change in pressure drop across the filter.

BRIEF DESCRIPTION OF THE DRAWINGS

A preferred embodiment of the present invention will now be described, by way of example, with reference to the accompanying drawings, in which:

FIG. 1 is schematic side elevational view of the feed region of a conventional prior art carding machine;

FIG. 2 is a schematic side elevational view of an alternative prior art carding machine;

FIG. 2A is an enlarged side elevational view of a region of the carding machine shown in FIG. 2;

DETAILED DESCRIPTION OF THE PREFERRED EMBODIMENTS

Figure 3:
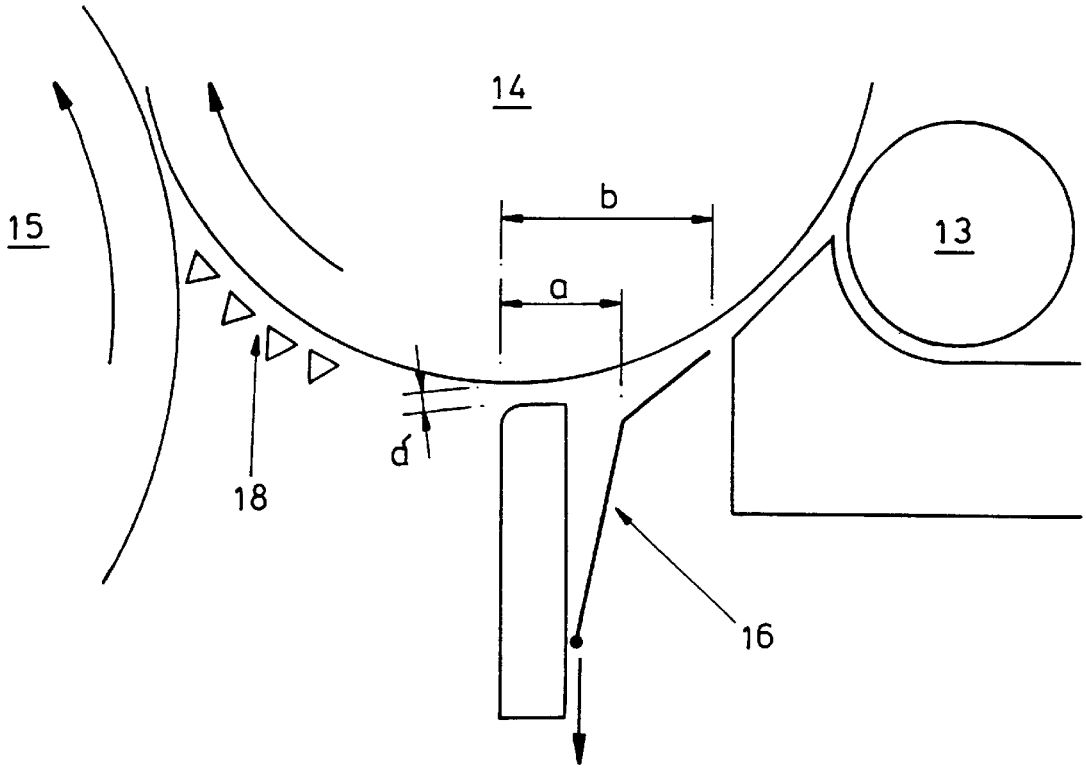
FIG. 3 is a schematic side illustration of a detail of a mote knife type of cleaning mechanism cooperating with the lower arc of a takerin of a carding machine.

A takerin 14 cooperates with a main carding cylinder 15, and a usual takerin screen 18 is mounted in the region between the takerin 14 and carding cylinder 15. A feed roller 13 and feed plate conveys feed stock along the lower arc of the takerin 14, and which is then transferred to the main carding cylinder. However, along the lower arc of the takerin 14, there is arranged an adjustable mote plate arrangement designated generally by reference 16. The mote plate arrangement 16 acts to divert trash and dust from the fibres carried by the takerin, and which falls downwardly under gravity for collection and monitoring, in a manner and purpose to be described in more detail below.

The setting of the mote plate arrangement 16 can be adjusted, when it is desired to vary the cleaning performance, and this may be necessary, from time to time, owing to changes in the type and quality of the feedstock, as well as by reason of wear taking place over a period of time. The adjustment may comprise adjustment radially relative to the axis of the takerin, in order to vary the radial clearance between the cleaning arrangement and the takerin periphery, but can also, or additionally, include circumferential adjustment to vary the length of the part annular cleaning path which is defined between the mote plate arrangement 16 and the takerin periphery. This type of adjustment will be determined by experimentation, according to the particular carding machine and the nature of the feedstock being used, to improve the cleaning performance, which will be well known to those skilled in the art.

However, an improvement which is provided by the present invention comprises sampling of the waste which is being removed, and which may be carried out on a continuous basis, intermittently, or at predetermined intervals. The waste, when it is required to be monitored, will be routed to a weighing system, and fluctuations in monitored weight, when compared with desired values, can be used to provide an indication of a deviation, and from which can be derived necessity to carry out appropriate adjustment of the setting of the mote plate arrangement.

Intermittent sampling of the waste material can be advantageous when the measuring means comprises a filter. The sampling can be effected by use of filter which can be moved between a sampling position in which the medium transporting the waste material is carried must pass through the filter and a by-pass position in which the medium can flow past the filter. Preferably, the filter can be moved between these positions by pivoting. The device can be arranged so that the air passing it when it is in the by-pass position dislodges collected waste material so that the filter is then ready for re-use.

In a sophisticated arrangement, which is within the scope of the present invention, automatic weighing of the waste may take place, and a feedback to the cleaning system which causes automatic and compensatory adjustment of the setting of the cleaning system.

In a less sophisticated arrangement, but which is still inventive and technically advantageous, the weighing system provides an indication e.g. a weighing signal, and when this is perceived, or monitored to deviate from a required norm, upon inspection this allows an operator to carry out appropriate adjustment of the setting of the mote plate arrangement.

There is therefore provided a card waste autolevelling system, which can reduce the proportion of usable fibres which are carried over with waste particles during cleaning of the lower arc of the takerin, by use of a card management system which monitors removed waste generated during treatment of a fibrous feedstock (to determine if it departs from a desired state) and which indicates a requirement for and/or initiates compensatory adjustment of a cleaning device which is removing the waste.

Figure 4:
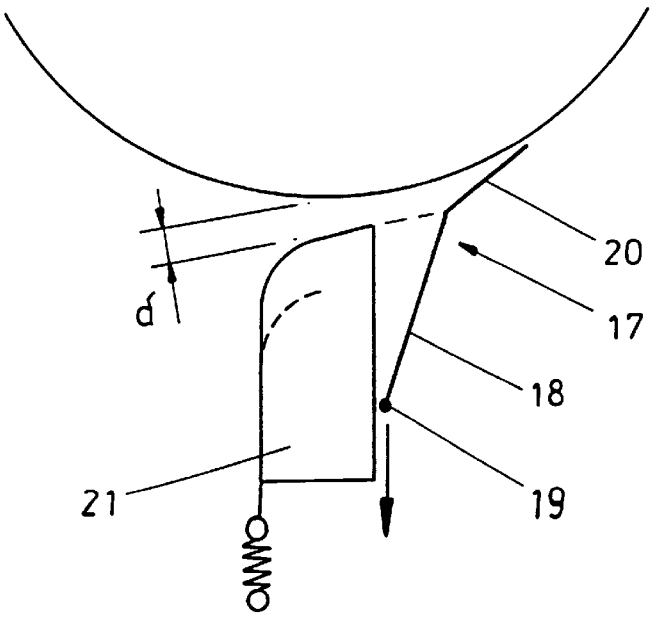
FIG. 4 is a detail view, similar to FIG. 3, showing a mode of adjustment of the mote knife.

FIG. 4 shows in more detail means whereby adjustment of the mote plate arrangement may take place, whereby an angled mote plate 17 can be adjusted, both radially, and also pivotally, to vary both the radial clearance and/or the length of the part annular cleaning passage defined between the mote plate and the takerin periphery. Mote plate 17 has a first part 18 mounted on pivot 19, and an angled second part 20 which extends tangentially, or near tangentially relative to the takerin periphery. A spring loaded plunger 21 carries pivot 19 and the mote plate 17, and can be adjusted in order to vary the radial spacing of the assembly relative to the takerin periphery.

Accordingly, the preferred embodiment, illustrated schematically in FIGS. 3 and 4, provides the following novel, inventive and technically advantageous features:

1. A built in sampling device, such as a weigh pan (not shown in FIGS. 3 and 4) with an automatically opening bottom as generally used in textile machinery applications, into which the waste from the taker in falls. The weight of the pan is automatically weighed, for instance by an electronic load cell, or by a linear transducer, if the pan is deflected by increasing load. The waste is from time to time emptied onto a waste transporting device, such as a suction plenum or an undercard belt such as our patent number EP-248649. The varying signal from the load cell is read continuously or intermittently, and the rate of the waste emitted by the taker in is thus computed. (An opening weigh pan 30, spring loaded lever 31 coupled to pan 30, load cell 32 and undercard belt 34 are shown in FIG. 1 as one preferred example of sampling device according to the invention. The weigh pan 30 is counter-balanced by a spring acting on lever 31, and increasing weight acts on load cell 32 which provides a suitable signal indicating the weight of the waste, and such signal being capable of being used to trigger an automatic feedback adjustment of the cleaning system. Periodic opening of the weigh pan 30 can allow the collected waste to be discharged to undercard belt 34 to take away the waste).

2. The device which controls the waste taken out by the taker in is now adjusted to take out more or less waste, depending whether the computed extraction rate is less or more than that desired. So called mote knife arrangements of any known form can be adjusted, such as 7 in FIG. 1, 10 in FIG. 2 or 16 in FIG. 3.

If the adjustment is automatic, then whatever parameter of the given setting device determines waste take out rates, that parameter is adjusted. The description of FIG. 4 is one such device. The re-adjustment of these parameters is in small steps, so as not to cause hunting, along well known material autolevelling lines. Alternatively, if the steps are small enough, there will not be any hunting anyway.

3. The measurement of waste extraction rate does not interfere with the running of the card.

4. A similar system can be used at all waste extraction points of the card, and including (not shown) use of movable flats co-operating with a carding cylinder to generate "flat strips", and which can be speed-adjusted when necessary in a variable speed set-up, or in a constant speed set-up, adjustment of a usual "percentage plate" may take place.

5. The monitoring of the waste produced by the movable (revolving) flats may comprise chopping the flat strips into a weigh pan, which is regularly emptied, and the flat strip extraction rate thus computed. By varying the speed of the revolving flats, the rate of flat strip extraction can thus be varied.

Figure 5:
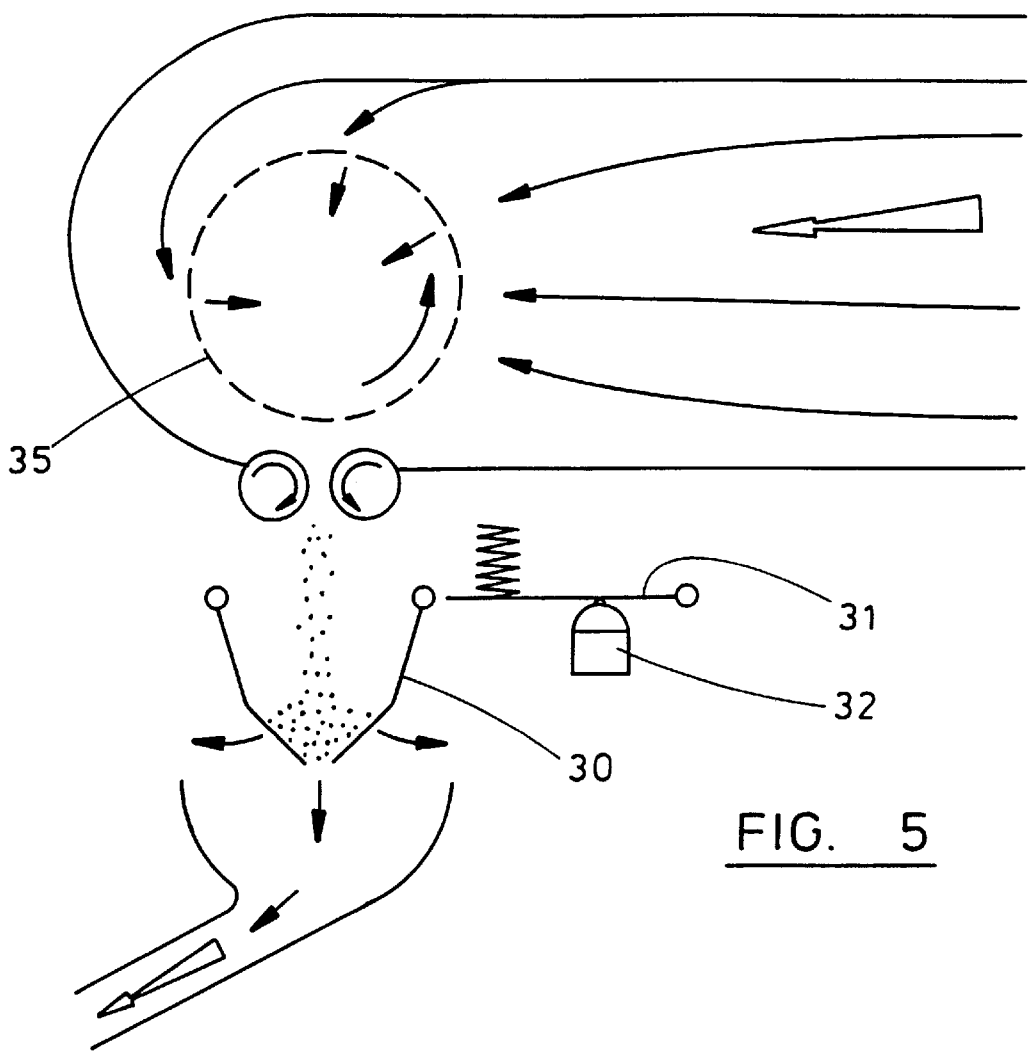
FIGS. 5 and 6 show details of a condenser system and means for adjusting dust removal.
Figure 6:
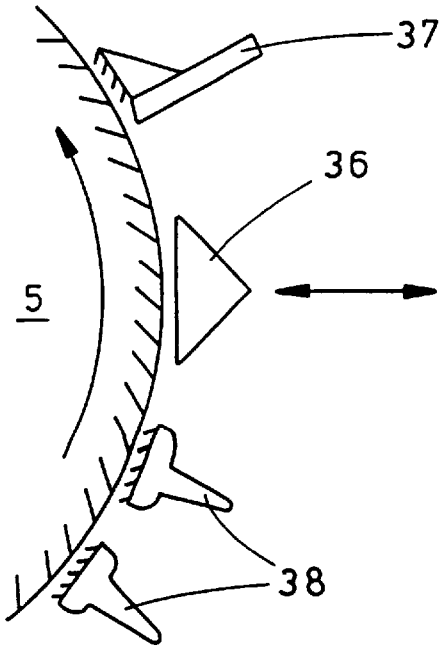

6. Some waste, such as cylinder waste (from item 5 in FIG. 1) consists mainly of fibres suspended in suction air. This waste can also be weighed, by, for instance, passing the dust laden air through a standard textile air system condenser. Such a condenser is shown schematically in FIG. 5. It comprises a cylindrical perforated condenser cage 35 which rotates, and allows waste carried as dust in an incident moving air stream to drop from the cage into a weigh pan 30. Automatic adjustments to the dust emitting devices can then be made. For example, a plate 36 adjacent to the roller 5 (and located between waste knife 37 and fixed flats 38) can be moved in or outward, to decrease or to increase waste extraction, as shown in FIG. 6.

There are therefore disclosed herein means for monitoring the generation of waste during operation of carding machines, and from this providing indications of cleaning efficiency, and which may be used so that manual or automatic compensatory adjustment of the cleaning system (and/or the component parts of the carding machine installation) can be carried out.

The generation of waste can be monitored by direct weighing of the waste, or extracted samples thereof, or by use of other means from which cleaning efficiency can be derived e.g. means whereby weight of waste being generated can be extrapolated.

The use of such other means also fall within the scope of the present invention. These other means may include optical methods, such as use of "scintillation" techniques; interruptions in the passage of light beams passed through a tube or passage through which the waste particles are conveyed; optical scanning of dust/waste held on a wire mesh screen; measurement of discolouration on a rotary mesh filter; and the absorbtion/reflection of light along the line of dust generation, such as the absorbtion of light from a beam which runs parallel and near to a slot from which waste is being expelled.

Figure 7:
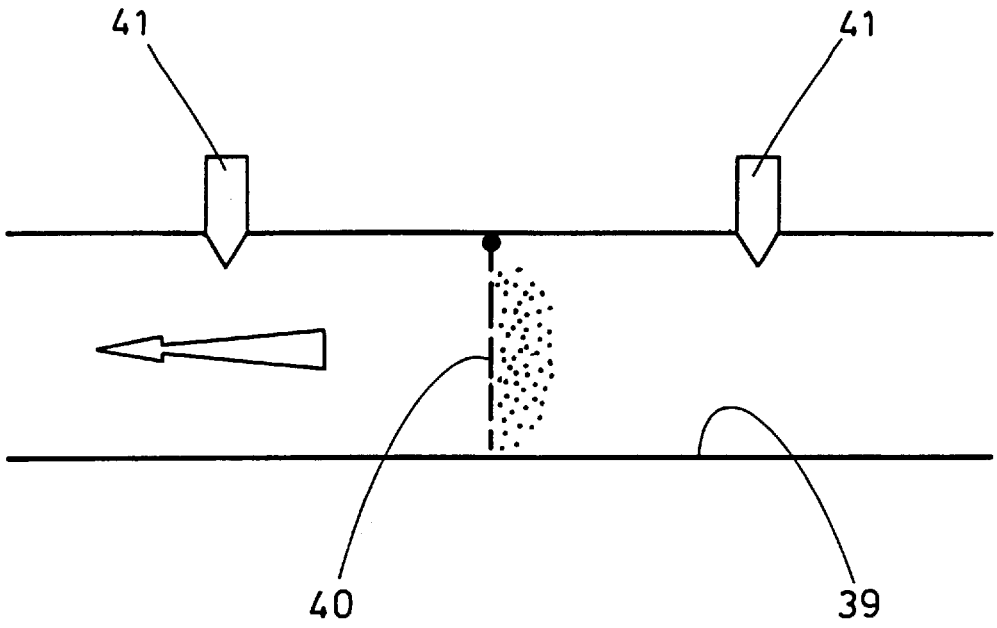
FIGS. 7 and 8 show a preferred embodiment of a machine which uses a filter in the measurement of the quantity of material that is removed from the fibres.
Figure 8:
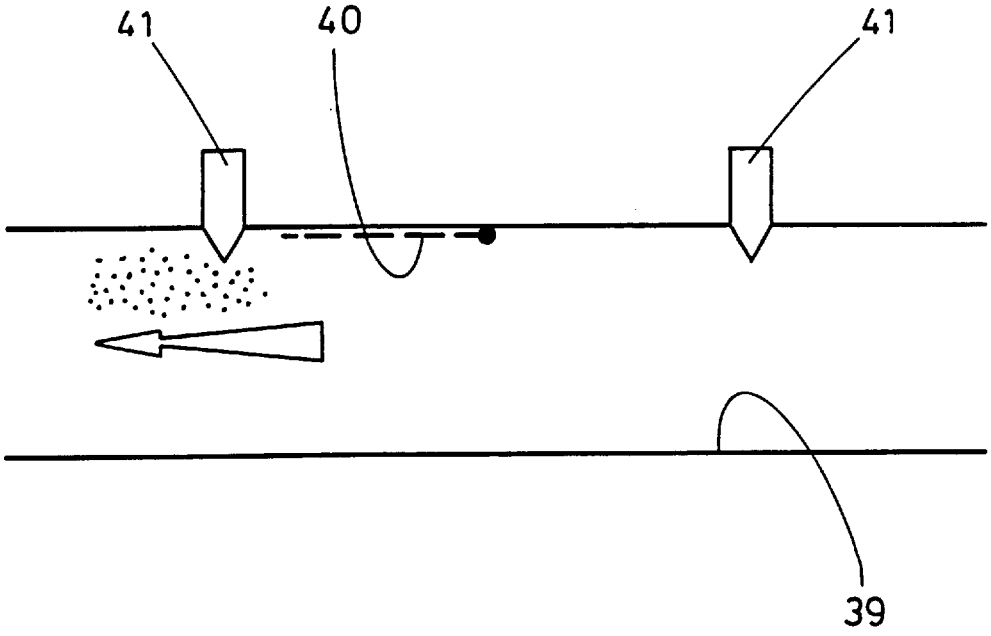

FIGS. 7 and 8 show an extraction tube 39 which includes a pivotable filter 40 mounted in it for an air stream that passes through the tube. Pressure transducers 41 are mounted in the tube, one on each side of the filter 40.

When the filter is in a sampling mode as shown in FIG. 7, the filter is lowered so that the air stream must pass through the filter. Waste material being carried by the air stream is collected on the filter. As the waste material collects on the filter 40, the pressure drop across the filter increases. This can be monitored by means of the pressure transducers 41. This in turn allows the rate of removal of waste material from the fibres to be determined. A signal can be generated directly according to the rate of removal, and transmitted to the feed plate which cooperates with the roller to remove waste material from the fibres.

When sampling is complete, the filter can be moved out of the air stream, by pivoting as shown in FIG. 8, so that waste material in the air stream can by-pass the filter. The bypassing air can then remove collected waste material from the filter.

I claim:

1. A carding machine for treating a fibrous feedstock comprising an adjustable cleaning device for removal of waste from the feedstock and; a machine management device for monitoring the waste removed by the cleaning device and for providing a compensatory feedback adjustment of the cleaning device when the monitored waste deviates from a desired state, the management device including a waste monitoring device configured to weigh the waste.

2. A carding machine according to claim 1 further including a taker-in having a lower arc portion, the cleaning device being arranged to cooperate with the movement of the lower arc portion of said taker-in.

3. A carding machine according to claim 2, in which the cleaning device is selected from the group consisting of an adjustable mote plate and an ajustable mote knife.

4. A carding machine according to claim 1 and including a carding cylinder and a set of moveable flats cooperating with said carding cylinder, in which the cleaning device is incorporated in said set of moveable flats.

5. A carding machine according to claim 4, in which the speed of the moveable flats is adjustable, whereby compensatory adjustment of the speed of the flats is obtained following monitoring of a deviation of the monitored waste from the desired state.

6. A carding machine according to claim 1, and arranged to weigh the waste on an intermittent basis.

7. A carding machine according to claim 6 wherein the waste monitoring device comprises a weigh pan system configured to weigh the waste.

8. A carding machine according to claim 7, including a load cell co-operating with the weigh pan.

9. A carding machine according to claim 1, and arranged to weigh the waste on a continuous basis.

10. A carding machine according to claim 1, including a carding cylinder and the cleaning device being configured to remove the waste from the feedstock when the feedstock is on the carding cylinder.

11. A carding machine for treating a fibrous feed stock and having an adjustable cleaning device for removal of waste from the feed stock and a machine management device for monitoring the waste removed by the cleaning device and for providing compensatory feedback adjustment of the cleaning device when the monitored waste deviates from a desired state, said carding machine including a carding cylinder and said management device including a monitoring device arranged to monitor a sample of dust generated/extracted from said carding cylinder, and in which the monitoring device comprises:

a filter moveably mounted in a duct for conveying an airborne stream of waste material, said filter being moveable between an operative position in the path of travel of the waste in order to collect the waste and an inoperative position wherein the filter is positioned substantially outside of the path of travel of the waste; and at least one pressure transducer arranged to monitor the change in pressure in the duct brought about by the collection of the waste on the filter, and thereby to generate a signal indicative of any deviation in the monitored waste from a desired state.

12. A carding machine for treating a fibrous feedstock comprising an adjustable cleaning device for removal of waste from the feedstock; a machine management device for monitoring the waste removed by the cleaning device and for providing a compensatory feedback adjustment of the cleaning device when the monitored waste deviates from a desired state; a carding cylinder; and a set of moveable flats cooperating with said carding cylinder, said cleaning device being incorporated in said set of moveable flats, the speed of the moveable flats being adjustable, whereby compensatory adjustment of the speed of the flats is obtained following monitoring of a deviation of the monitored waste from the desired state.

* * * * *